United States Patent [19]

Mawby et al.

[11] Patent Number: 4,543,800

[45] Date of Patent: Oct. 1, 1985

[54] REFRIGERATOR DOOR HINGE

[75] Inventors: Harold S. Mawby, Belding; Burdith W. Johnston, Greenville, both of Mich.

[73] Assignee: White Consolidated Industries, Inc., Cleveland, Ohio

[21] Appl. No.: 580,885

[22] Filed: Feb. 16, 1984

[51] Int. Cl.[4] ..... F25D 23/12

[52] U.S. Cl. ..... 62/339; 62/398; 62/441; 62/531; 339/4

[58] Field of Search ..... 62/338, 339, 398, 441, 62/531; 339/4; 49/20

[56] References Cited

U.S. PATENT DOCUMENTS

| | | | |
|---|---|---|---|
| 2,522,989 | 9/1950 | Carbary | 173/324 |
| 2,665,414 | 1/1954 | Hubacker et al. | 339/4 |
| 2,700,139 | 1/1955 | Jewell | 339/4 |
| 3,076,163 | 1/1963 | Nodge et al. | 339/4 |
| 3,089,202 | 5/1963 | Pulaski | 20/16 |
| 3,156,019 | 11/1964 | Dawley | 20/16 |
| 3,429,140 | 2/1969 | White | 62/339 |
| 4,036,620 | 7/1977 | Benasutti et al. | 62/338 |

*Primary Examiner*—Lloyd L. King

*Attorney, Agent, or Firm*—Pearne, Gordon, Sessions, McCoy, Granger & Tilberry

[57] ABSTRACT

The door-mounted water and ice cube dispenser of a refrigerator is supplied with chilled water and electrical power by a water conveying conduit and a plurality of electrical conductors which together pass through a hollow pintle and socket portion of a lower hinge assembly pivotally supporting the refrigerator door. To facilitate removal of the door from the associated refrigerator cabinet, the lower end of the conduit is connected to an end of a chilled water supply line by a union type coupling, the lower ends of the conductors being connected to a plug engageable with an associated power supplying socket fixed to the refrigerator cabinet. The conduit and conductors extend upwardly from the lower hinge assembly to the dispenser location via the interior of an elongated, rigid, tubelike member that isolates the conduit and conductors from any thermal insulating material or other obstructions filling the interior volume of the door. The tubelike member, by permitting unimpeded movement of the conduit and conductors contained therein, precludes localized twisting and untwisting of the conduit and conductors at any specific point along their respective lengths to preclude fatigue breaks of the conduit or conductors resulting from repeated opening and closing of the door.

9 Claims, 7 Drawing Figures

REFRIGERATOR DOOR HINGE

BACKGROUND OF THE INVENTION

The present invention relates in general to hinge structures, and specifically to the lower hinge assembly of a refrigerator door having an electrically operated water and ice cube dispenser, wherein water and electrical power are provided to the dispenser by a water conveying conduit, and by a plurality of electrical conductors constituting a wiring harness, the conduit and conductors together passing through the lower hinge assembly for connection to a water supply line and an electrical control circuit of the refrigerator.

Door-mounted water and ice cube dispensers are well known in the art. U.S. Pat. No. 3,429,140 discloses a water and ice cube dispenser supplied with water by a water conveying conduit connected to a supply line via the lower hinge assembly which pivotally supports the door. Thus, the lower hinge assembly illustrated in the '140 patent serves a dual function, i.e., it pivotally supports the door at its lower end, and it provides for the passage of a water conveying conduit connected between the door-mounted dispenser and the water supply line.

It is also known in the art to provide a lower hinge assembly for a refrigerator door which provides for passage therethrough of a plurality of electrical conductors connected between the electrical control circuit of the refrigerator and a door-mounted electrical device, such as the electronic control assembly illustrated in U.S. Pat. No. 4,404,813.

To the best of the inventor's knowledge, there exists no lower hinge structure for a refrigerator door which provides for the passage of both a water conveying conduit and a plurality of electrical conductors for connection to an electrically operated water and ice cube dispenser supported by the refrigerator door. Such a hinge would perform three functions, namely, the pivotal support of the door at its lower end, the passage therethrough of a water conveying conduit, and the passage therethrough of a plurality of electrical conductors.

Numerous requirements must be met in providing such a multifunction hinge assembly.

For example, the hinge structure must be rugged and strong to permit repeated opening and closing of the refrigerator door over its 10 to 20-year life span.

Also, means must be provided to preclude fatigue breakage of the conduit and conductors passing through the hinge, such fatigue breakage being caused by localized twisting and untwisting of the conduit and conductors at a point along their length as the door is repeatedly opened and closed.

Additionally, the overall lower hinge assembly must be generally airtight relative to the interior of the refrigerator door to preclude the build-up of condensate inside by door by relatively humid room air entering the door interior via the hinge assembly.

Also, such a hinge structure must be relatively inexpensive to manufacture and assemble due to the highly cost-competitive nature of the domestic appliance industry.

Finally, the hinge assembly must permit easy removal of the door to facilitate servicing.

The foregoing requirements and others are met by the present invention.

SUMMARY OF THE INVENTION

In accordance with the present invention, a multifunction lower hinge assembly for mounting a water and ice cube dispenser-type refrigerator door on its associated refrigerator cabinet is provided.

The electrically operable dispensing mechanism is located above the lower hinge assembly and is connected to a water supply line, and an electrical control circuit of the refrigerator, by a water conveying conduit and a plurality of electrical conductors constituting a wiring harness. The conduit and conductors extend downwardly from the dispenser, and are connected to the water supply line and the control circuit via the hinge assembly.

The hinge assembly includes a bracket means fixed to the lower portion of the refrigerator cabinet. A first annular member is fixed to the bracket means, while a second annular member is fixed to the door. The second annular member fixed to the door rotatably engages the first annular member fixed to the bracket means to permit pivotal movement of the door relative to the cabinet. The annular members are coaxially aligned, one annular member being nested within the other. The conduit and conductors both pass through the interior volumes of the annular members for connection to the water supply line and the control circuit.

Preferably, a pluglike member having separate apertures for engaging and receiving the conduit and each of the conductors is press-fitted into the interior of the first annular member acting as a pintle, the second annular member acting as a socket to rotatably receive the pintlelike first annular member. The pluglike member spaces the conduit and conductors from each other and from the first annular member. The pluglike member also serves as a seal to preclude the entry of humidified room air into the door via the annular pintlelike member.

A rigid, tubelike member, located within the interior of the door structure, extends upwardly from the hinge assembly to the dispenser area. The conduit and conductors are contained within the tubelike member to isolate them from other internal door structures, such as thermal insulation material. The conduit and conductors are thus freely movable within the tubelike member so that twisting and untwisting of the conduit and wires are spaced out over their entire lengths within the tubelike member. Such a feature avoids localized twisting and untwisting of the conduit and conductors that could result in fatigue breakage of the conduit and/or conductors after repeated opening and closing of the refrigerator door.

BRIEF DESCRIPTION OF THE DRAWINGS

A fuller understanding of the invention may be had by referring to the following description and claims taken in conjunction with the accompanying drawings, wherein:

DETAILED DESCRIPTION OF THE PREFERRED EMBODIMENT

Figure 1:
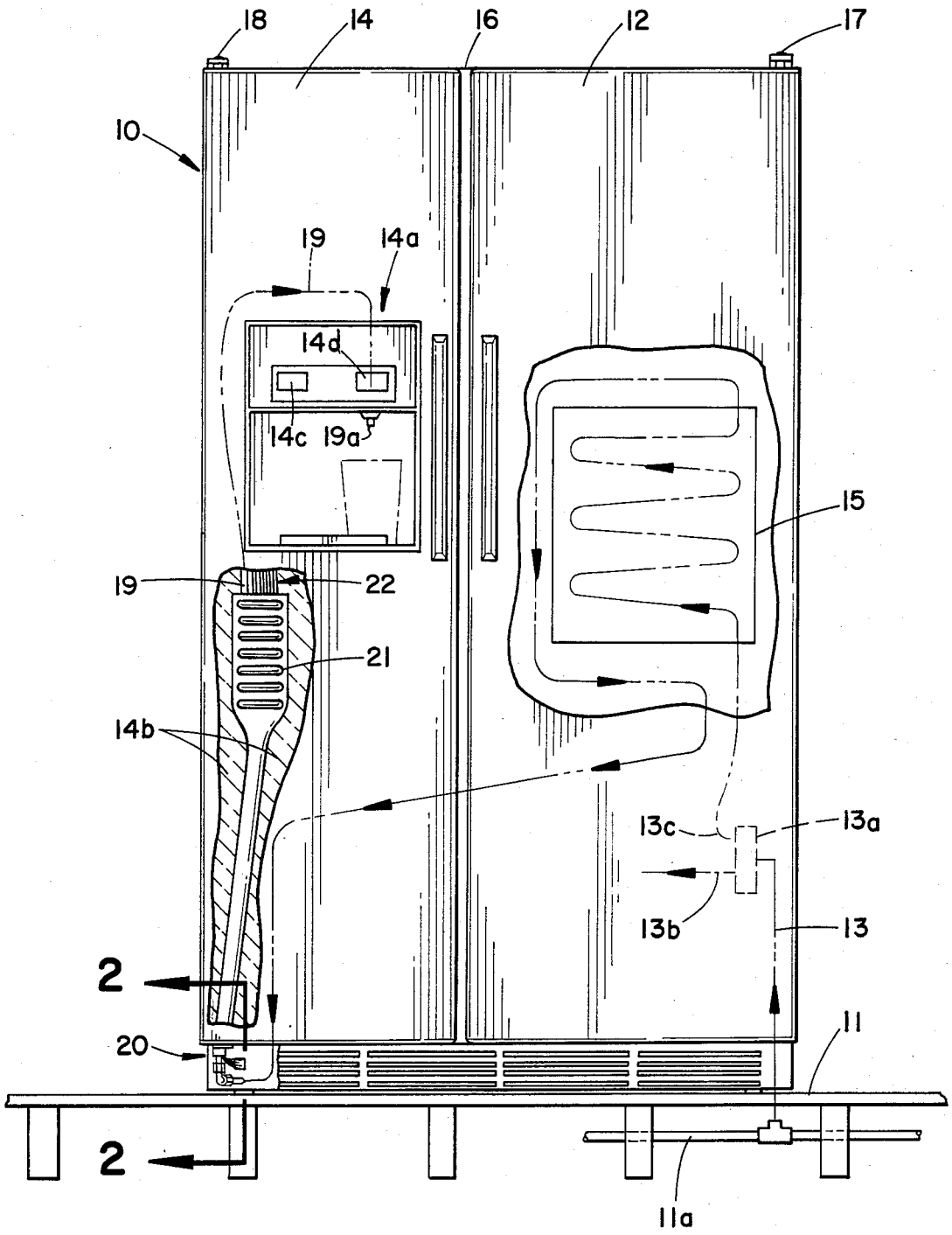
FIG. 1 is a front elevational view of a refrigerator of the domestic type having a water and ice cube dispensing type door pivotally supported in part by a lower door hinge assembly in accordance with the present invention, portions of the refrigerator being cut away for purposes of illustration.

With reference to FIG. 1 of the drawings, a refrigerator 10 of the domestic type is illustrated. The refrigerator 10, in typical fashion, rests upon and is suppported by a floor structure 11 of the house in which it is being used. The floor structure 11 has incorporated in it a conventional cold water pipe 11*a*, as illustrated. The water pipe 11*a* supplies cold water to the refrigerator 10 for its use in making ice and in dispensing cold water to a user, as will be subsequently discussed.

The refrigerator 10 includes a first door 12 and a second door 14 pivotally mounted on a refrigerator cabinet 16. The cabinet 16 is divided into two compartments, namely, a refrigerator compartment accessible via the first door 12 or refrigerator door, and a second, smaller freezer compartment accessible by the second door 14 or the freezer door. The refrigerator door 12 pivots, between open and closed positions, about a vertical axis provided by a refrigerator door upper hinge assembly 17 and a related lower hinge assembly (not illustrated). In a similar fashion, the freezer door 14 pivots, between open and closed positions, on a vertical axis provided by a freezer door upper hinge assembly 18 and a lower hinge assembly 20 in accordance with the present invention.

As is well known in the art, the larger refrigerator compartment closed by the door 12 is maintained at a temperature between freezing and room temperature to cool food products contained therein. The smaller freezer compartment closed by the door 14 is maintained at a temperature below freezing to freeze food products placed therein. The refrigerator 10 is commonly known as a "side-by-side refrigerator/freezer."

The freezer door 14 includes as an integral portion thereof a conventional water and ice cube dispenser 14*a* mounted in an aperture in the upper central portion of the door 14, as illustrated. The dispenser 14*a* is electrically operated, and is supplied with ice cubes by an ice-making mechanism (not shown) located inside of the freezer compartment closed by the freezer door 14. The dispenser 14*a* is also supplied with chilled water by a flexible plastic tube constituting a water conveying conduit 19 having a distal end 19*a* for dispensing water into, for example, a glass or the like. The water conveying conduit 19 and a plurality of conductors 22, e.g., standard insulated wires, connected to the dispenser 14*a* for its electrical operation, pass together through the lower hinge assembly 20, as will be illustrated in greater detail. The conductors 22, having passed through the lower hinge assembly 20, are connected to the electrical control circuit of the refrigerator 10. The lower end of the water conveying conduit 19 is connected to the outlet of a conventional water chiller 15 having its inlet connected to one outlet 13*c* controlled by one solenoid of a dual soleniod-actuated water valve 13*a*. The valve 13*a* also includes a second outlet 13*b*, controlled by the second solenoid of the valve 13*a*, which provides water to the ice-making mechanism within the freezer compartment closed by the door 14. The inlet of the valve 13*a* is suppled with water by a water supply line 13 connected between the cold water pipe 11*a* and the valve 13*a* as illustrated.

As is well known in the art, when a switch pad 14*d* is depressed by the user, solenoid-actuated valve 13*a* will be energized to connect water pipe 11*a* with the inlet to the chiller 15, wherein the water pressure in pipe 11*a* will force water out of the open distal end 19*a* of the water conveying conduit 19. When the switch pad 14*d* is no longer depressed, solenoid-actuated valve 13*a* will be de-energized to terminate water flow from the distal end 19*a*. In a similar fashion, depression of a switch pad 14*c* will cause the dispensing of ice cubes.

The hinge assembly 20 includes a hollow, rigid, tubelike member 21 shaped like a paddle, the water conveying conduit 19 and conductor 22 being contained therein to isolate them from, for example, thermal insulation material 14*b* contained within the structure of the door 14. The tubelike member 21, preferably formed from plastic material, functions as a fatigue breakage precluding means that prevents breakage of the conductors and/or the conduit, such breakage being caused by localized twisting and untwisting thereof at a point along their lengths when the refrigerator door is repeatedly opened and closed. Thus, the tubelike member 21 allows the conductors 22 and conduit 19 to move freely within the tubelike member 21 as the door 14 is opened and closed. Preferably, the diameter of the tubelike member 21 is substantially greater than the combined diameters of the conductors 22 and the conduit 19 to ensure free movement of the conductors within the tubelike member.

Figure 2:
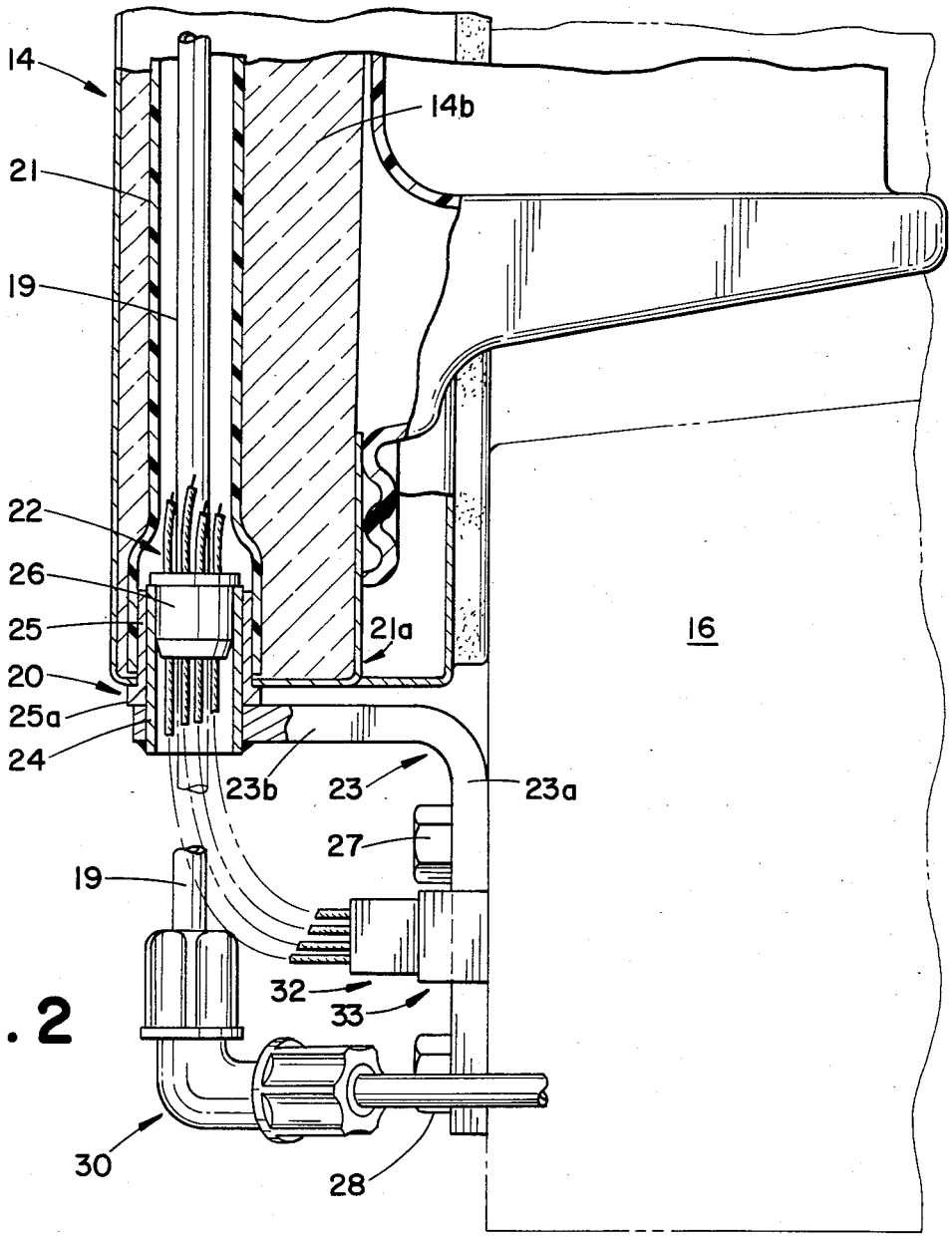
FIG. 2 is a cross-sectional side view of the lower hinge assembly area taken along line 2—2 of FIG. 1.
Figure 4:
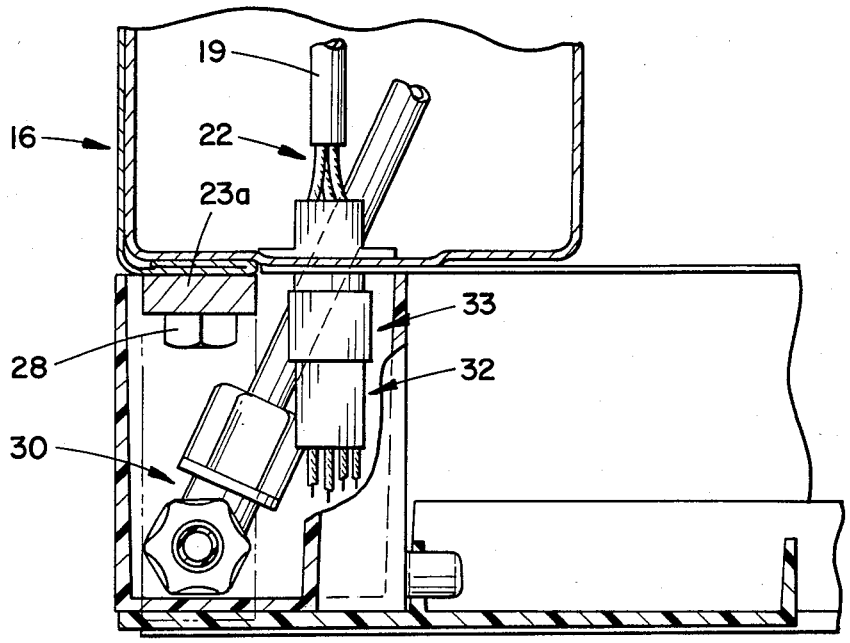
FIG. 4 is a cross-sectional top view of the lower hinge assembly area taken along line 4—4 of FIG. 3.
Figure 3:
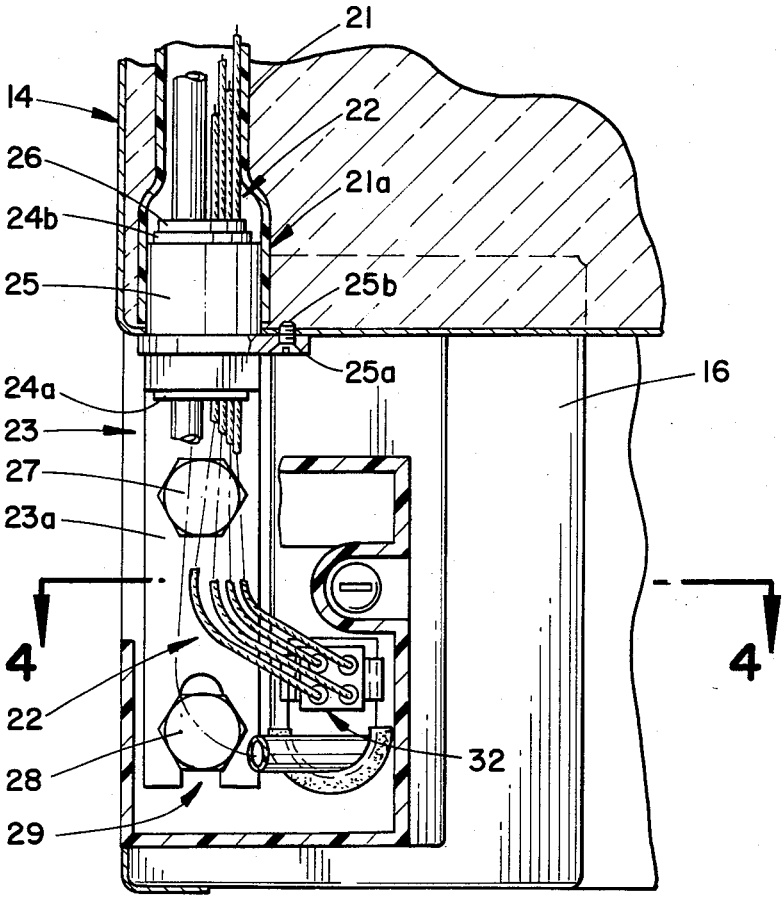
FIG. 3 is a cross-sectional front view of the lower hinge assembly area illustrated in FIG. 2.

With reference to FIGS. 2 through 4, the lower hinge assembly 20, in accordance with the present invention, is more clearly illustrated. An L-shaped hinge support bracket 23 includes a vertical leg 23*a* fixed to the bottom face of the cabinet 16 by a pair of bolts 27,28. The support bracket 23 also includes a horizontal leg 23*b* which has an aperture at its distal end for fixedly receiving a first hollow annular member 24 which functions as a pintle, the first annular member 24 having a lower end 24*a* which is welded to the horizontal leg 23*b* of the bracket 23.

The lower hinge assembly 20 further includes a second annular member 25 functioning as a socket or bearing bushing. The socketlike second annular member 25 is fixed within an aperture provided in the bottom edge or face of the door 14. The socketlike second annular member 25 rotatably fits over and receives the first annular pintlelike member 24 fixed to the bracket 23 wherein the members 24,25 are coaxially aligned, the pintlelike member 24 being nested within the socketlike member 25, and the weight of the door 14 being borne by the upper, annular surface area of the leg 23*b* immediately surrounding the member 24. The first annular member 24 and the bracket 23 are preferably formed of wear-resistant, electrically conductive steel, while the second annular member 25 is formed of graphite-impregnated, sintered bronze material to provide electrical grounding of the door 14 to the cabinet 16 via bracket leg 23*b*.

The water conveying conduit 19 and the conductors 22 pass through the interior volumes of the rotatably annular members 24, 25 for connection to the water supply and control circuitry of the refrigerator as discussed earlier with regard to FIG. 1.

The hinge assembly 20, in accordance with the present invention, also includes means for fixing the water conveying conduit 19 and the conductors 22 in position within the interior volume of the first annular member 24. This means for fixing also functions as a seal means to generally hermetically seal the conduit 19 and conductors 22 in fixed position within the first annular member 24. Such fixing and sealing means is preferably provided in the form of a plastic, pluglike member 26, which is press-fitted into a top end 24*b* of the first annular pintlelike member 24. As will be subsequently illustrated, the pluglike member 26 includes individual apertures for each of the conductors 22 and for the conduit 19, the apertures each having walls that tightly grip the conductors and the conduit to provide a hermetic seal interface between the pluglike member 26 and each of the elements passing through it. Preferably, the plastic pluglike member 26 is molded onto the conductors 22 prior to the pluglike member 26 being pressfitted into the top end 24*b* of the first annular member 24.

The lower ends of the conductors 22 are connected to an electrical plug member 32 which is inserted into a corresponding socket member 33 mounted in fixed position on the cabinet 16 connected to the control circuitry of the refrigerator 10, as discussed earlier. In a similar manner, the lower end of the water conveying conduit 19 is connected to one end of an elbow-type union 30 having its other end connected to the water supply line extending from the outlet of the water chiller 15 (see FIG. 1). It can be seen that the plug member 32 and the union 30 allow for ready connection and disconnection of the water conveying conduit 19 and the conductors 22 to the water supply and control circuitry of the refrigerator 10. Thus, the door can be easily removed from the refrigerator cabinet by simply unbolting the bracket 23 from the cabinet 16, i.e., by unscrewing bolts 27 and 28 once the plug 32 has been disconnected from the socket 33 and once the lower end of the conduit 19 is then disconnected from the union 30. In the alternative, the union 30 can be left connected to the conduit 19 and be disconnected from the end of the supply line extending from the interior of the cabinet.

The rigid tubelike member 21 extends longitudinally upwardly from the lower hinge assembly 20 to the dispenser location as discussed earlier and illustrated with regard to FIG. 1. The lower end 21*a* of the member 21 is expanded to permit it to be press-fitted over the top end of the second annular member 25. It can be appreciated that the tubelike member 21 will be fixed in position within the door since it is mounted on the annular socketlike member 24. Thus, when the door is opened and pivotally moved outwardly away from the cabinet of the refrigerator, limited twisting of the wires 22 and the conduit 19 will occur within the rigid tubelike member 21, such twisting and untwisting being spread out over the lengths of the wires 22 and conduit 19 contained within the tubelike member 21 to preclude localized twisting and untwisting of the wires that could result in fatigue breakage as discussed earlier.

With particular reference to FIGS. 3 and 4, the relative positions of the plug 32, the socket 33, and the union 30 are further illustrated. It can be seen that the socket member 25 includes a lower flange portion 25*a* (also see FIG. 5) through which a socket retaining screw 25*b* extends and is screwed into a threaded aperture in the door 14. Thus, the second annular socketlike member 25 is held in fixed position relative to the door.

The lower leg 23*a* of the bracket 23 can be seen to include a slot 29 which receives the lowermost bolt 28 used to mount the bracket to the cabinet 16 of the refrigerator 10. When it is desired to remove the refrigerator door 14 from the refrigerator cabinet 16, bolt 27 is removed and bolt 28 is loosened so that the door with the bracket attached thereto can be lifted up off the bolt 28. Such a feature facilitates removal and servicing of the door.

Figure 5:
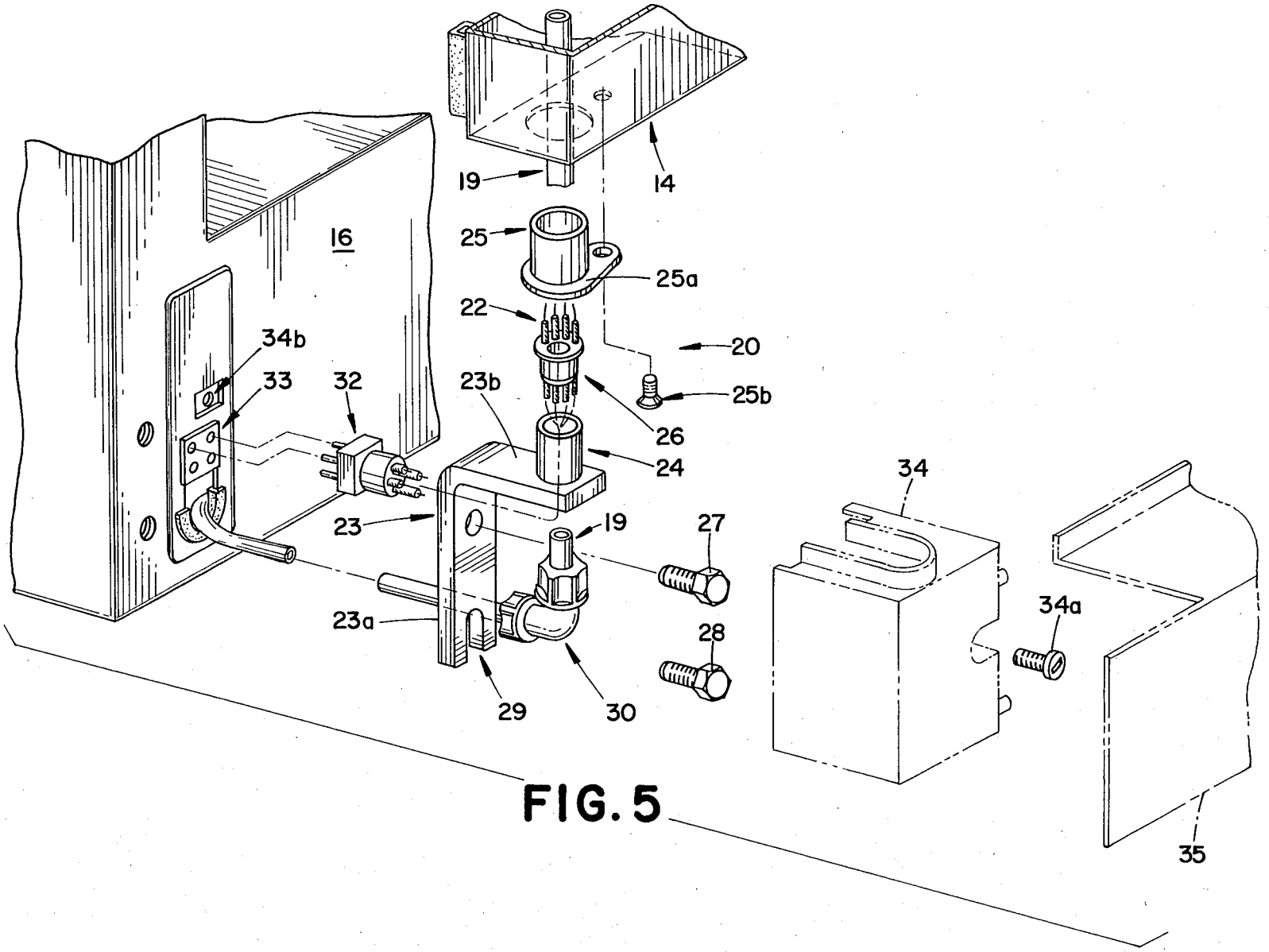
FIG. 5 is an exploded, perspective view of the lower hinge assembly area illustrated in FIGS. 2 through 4.

With reference to FIG. 5, the elements of the door hinge assembly 20, discussed above, are illustrated in further detail. FIG. 5 also illustrates, in phantom view, a cover member 34 formed, for example, of plastic which fits over the hinge assembly 20 and is retained in such position by a cover anchoring screw 34*a* which is received by a corresponding threaded aperture 34*b* provided in the refrigerator cabinet 16, as illustrated. An end portion of a conventional refrigerator kick plate 35 extends over the cover 34*a*, as illustrated, to preclude access to the screw 34*a* by non-authorized personnel.

Figure 6:
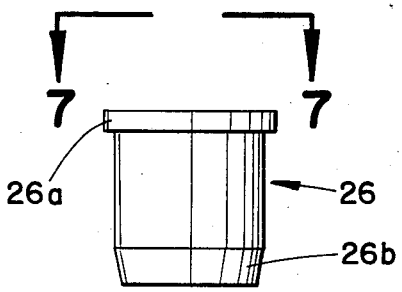
FIG. 6 is a side view of a pluglike member forming a part of the illustrated preferred embodiment of the lower hinge assembly.
Figure 7:
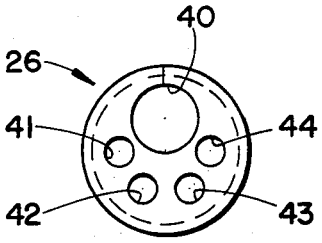
FIG. 7 is a top view of the pluglike member of FIG. 6 taken along line 7—7 thereof.

With reference to FIGS. 6 and 7, the pluglike member 26 can be seen to have a lower, tapered end 26*b* which facilitates insertion of the member 26 into the top of the pintlelike first annular member 24, as discussed earlier. The pluglike member 26 also includes an upper flange 26*a* which serves as a stop to limit the degree to which the plug can be press-fitted down into the top of the member 24.

With specific reference to FIG. 7, the pluglike member 26 includes a plurality of four separate wire receiving apertures 41, 42, 43, and 44 and a larger aperture 40 having a split wall, as illustrated, which facilitates insertion of the water conveying conduit 19 into the aperture 40 during assembly of the refrigerator door.

It will be recognized by those skilled in the art that the plastic plug member 26 is formed of electrical insulating material, and that each of the conductors in the water conveying conduit pass through their own one of the apertures in the pluglike member wherein the pluglike member maintains the conductors and the conduit in spaced-apart, electrically isolated relationship relative to each other and relative to the metal pintlelike member 24.

It has been found that the hinge assembly 20 in accordance with the invention as discussed above is relatively inexpensive and provides highly reliable service over a long period of time. Further, the hinge assembly is relatively inexpensive to manufacture so as to meet the competitive requirements of the domestic appliance industry.

Although the preferred embodiment of this invention has been shown and described, it should be understood that various modifications and rearrangements of the parts may be resorted to without departing from the scope of the invention as disclosed and claimed herein.

What is claimed is:

1. In a refrigerator having a lower hinge assembly for pivotally mounting a refrigerator door on an associated refrigerator cabinet, the door including a dispensing mechanism for water and/or ice cubes, the dispensing mechanism being located above the lower hinge assembly and being connected to an electrical control circuit of the refrigerator by a plurality of electrical conductors, the conductors extending downwardly from the dispenser and being connected to the electrical control circuit via the lower hinge assembly, means for precluding fatigue breakage of the conductors caused by localized twisting and untwisting thereof, at a point along their lengths, when the refrigerator door is repeatedly opened and closed, said fatigue breakage precluding means comprising:

an elongated, generally rigid, tubelike member extending from the lower hinge assembly upwardly to the dispenser, the tubelike member being located in the interior of the door, the tubelike member containing therein said conductors to isolate them from other door structures, said conductors being free to move within said tubelike member so as to allow unimpeded twisting and untwisting of the conductors along their entire lengths within said tubelike member as said door is opened and closed.

2. A fatigue breakage precluding means according to claim 1, wherein said tubelike member is supported at its lower end in fixed relation to the door.

3. A fatigue breakage precluding means according to claim 1, wherein the diameter of the tubelike member is greater than the combined diameters of the conductors to allow free movement of the conductors within the tubelike member.

4. A lower hinge assembly for pivotally mounting a refrigerator door on an associated refrigerator cabinet, the door including an electrically operated mechanism for dispensing water and/or ice cubes, the dispensing mechanism being located above the lower hinge assembly and being connected to a water supply and an electrical control circuit by a water conveying conduit and a plurality of electrical conductors, the conduit and conductors extending downwardly from the dispenser and being connected to the water supply and control circuit of the refrigerator via the lower hinge assembly, said assembly comprising:

a bracket means affixed to the lower portion of the refrigerator cabinet;

an upwardly extending hollow, annular pintle member fixed at its lower end to the bracket means; and a hollow, annular socket member fixed to the refrigerator door, said socket member rotatably receiving said fixed pintle member, said conduit and conductors passing through the interior volumes of both said annular pintle and socket member for connection to said water supply and control circuit, said conduit and conductors being fixed in position within said interior volume of said pintle member, said hinge assembly including a plug member press-fitted into the fixed pintle member, the plug member having a plurality of apertures through which said conduit and conductors extend, said plug member apertures having walls that tightly grip at least said conductors to fix the lower ends of said conductors in position relative to said refrigerator cabinet when said door is moved between opened and closed positions.

5. A hinge assembly according to claim 4, wherein said plug member is molded about said conductors to engage them and establish with each of them a hermetic seal interface.

6. A hinge assembly according to claim 4, wherein said plug member is press-fitted into the upper end of the pintle member, the plug member being formed of electrical insulating material, each of said conductors and said conduit passing only through their own one of said respective apertures in said pluglike member, said plug member maintaining said conduit and conductors in spaced-apart electrically isolated relationship relative to each other and relative to said pintle member.

7. A lower hinge assembly for pivotally mounting a refrigerator door on an associated refrigerator cabinet, the door including an electrically operated mechanism for dispensing water and/or ice cubes, the dispensing mechanism being located above the lower hinge assembly and being connected to a water supply and an electrical control circuit by a water conveying conduit and a plurality of electrical conductors, the conduit and conductors extending downwardly from the dispenser and being connected to the water supply and control circuit of the refrigerator via the lower hinge assembly, said assembly comprising:

a bracket means affixed to the lower portion of the refrigerator cabinet;

an upwardly extending hollow, annular pintle member fixed at its lower end to the bracket means; and a hollow, annular socket member fixed to the refrigerator door, said socket member rotatably receiving said fixed pintle member, said conduit and conductors passing through the interior volumes of both said annular pintle and socket member for connection to said water supply and control circuit, said conduit and conductors being fixed in position within said interior volume of said pintle member, said hinge assembly including a generally rigid, tubelike member longitudinally extending upwardly from said lower hinge assembly to said dispenser location, said conduit and conductors being contained within said tubelike member.

8. A hinge assembly according to claim 7, wherein the lower end of said tubelike member is pres-fitted over and tightly engages an upper end of the socket member receiving the pintle member.

9. A hinge assembly according to claim 7, wherein said conduit and conductors are freely movable within said tubelike member to minimize localized twisting of the conduit and conductors at any specific point along their lengths as the refrigerator door is opened and closed.

* * * * *